United States Patent [19]

Devir et al.

[11] Patent Number: 4,603,278

[45] Date of Patent: Jul. 29, 1986

[54] ELECTRIC LAMP WITH INSULATING BASE

[75] Inventors: Daniel D. Devir, Sutton; Richard J. Dolan, Bradford; James P. Szep, Peterborough, all of N.H.

[73] Assignee: GTE Products Corporation, Stamford, Conn.

[21] Appl. No.: 580,929

[22] Filed: Feb. 16, 1984

[51] Int. Cl.[4] ..... H01J 5/48; H01J 5/50

[52] U.S. Cl. ..... 313/318; 313/315; 339/144 R; 339/145 R

[58] Field of Search ..... 313/318, 315, 323, 324; 339/144 R, 145 R

[56] References Cited

U.S. PATENT DOCUMENTS

| | | | |
|---|---|---|---|
| 3,739,221 | 6/1973 | DeBleyKer et al. | 313/318 |
| 3,781,755 | 12/1973 | Pitacco | 339/14 R |
| 3,781,768 | 12/1973 | Howe | 339/125 L |
| 3,898,506 | 8/1975 | Willoughby et al. | 313/318 |
| 3,910,668 | 10/1975 | Wasmeir | 339/65 |
| 3,979,627 | 9/1976 | Leadvaro et al. | 313/318 |
| 4,028,577 | 6/1977 | Gates et al. | 313/318 |
| 4,243,907 | 1/1981 | Kohl et al. | 313/315 |

*Primary Examiner*—David K. Moore
*Assistant Examiner*—M. Razavi
*Attorney, Agent, or Firm*—Lawrence R. Fraley

[57] ABSTRACT

An electric, incandescent lamp including an electrically insulating (e.g., plastic) base which is securedly positioned on the lamp's sealed end portion without the need for adhesives or the like. The base functions to securedly retain the lamp's lead-in wires (a total of four in a dual filament lamp) in a preestablished alignment externally of the lamp's sealed end (from which the wires project) to thereby assure positive electrical connection thereto when the lamp and base are inserted within a corresponding electrical socket. The invention is ideally suited for use in a tail light assembly for an automobile.

8 Claims, 3 Drawing Figures

ELECTRIC LAMP WITH INSULATING BASE

TECHNICAL FIELD

The invention relates to electric incandescent lamps and, more particularly, to such lamps which include an electrically insulating base as part thereof.

BACKGROUND

The features of the present invention are particularly useful as applied to the construction of incandescent lamps employed in automobiles, such as the dual-filament lamps employed in tail light assemblies.

One well known example of existing lamps of this type generally employed a type S-8 glass bulb cemented in a brass, double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production thereof. Further, the lamp to base construction for dual filament lamps of this type requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

One attempted solution to the several aforementioned problems inherent in brass base lamps is defined in U.S. Pat. No. 4,028,577 (P. E. Gates et al), said patent assigned to the same assignee as the instant invention and being a continuation-in-part of U.S. Pat. No. 3,979,627 (S. J. Leadvaro et al). In 4,028,577, there is described an electric lamp having a sealed end containing therein (or extending therefrom) a reentrant glass stem sealed about its periphery to the glass bulb. This end is positioned within a plastic base having a cylindrical body portion (for housing the somewhat cylindrical-shaped sealed end) and adjacent wedge portion. While this concept proved advantageous in several ways over the aforementioned brass base lamps, it was necessary to provide additional features, steps, etc. in order to satisfactorily produce and utilize this arrangement. For example, it was necessary to position the extending tip segment (from the sealed end) a sufficient distance from the base's inner, bottom wall in order to provide protection thereof. Maintenance of this distance was assured by cementing the bulb (along the outer walls) to the base. It was also necessary in this design to pass the lamp's projecting lead-in wires through corresponding passages (holes) within the base, thus mandating a relatively complex (and time-consuming) alignment and insertion procedure. Even further, final lead-in wire retention necessitated yet another production step (e.g., heat staking) which added still further to the cost of this lamp.

DISCLOSURE OF THE INVENTION

It is therefore a primary object of this invention to enhance the electric lamp art.

It is a particular object of this invention to provide an electric lamp which is relatively simple in design, can be readily and inexpensively produced and which eliminates the need for soldering or the like and the typical problems associated therewith.

It is yet another object of this invention to provide such a lamp wherein the lamp's projecting lead-in wires are both positively aligned and retained externally of the lamp's sealed end to thereby assure positive electrical connection thereto when the lamp is positioned (e.g., inserted) within a corresponding socket component.

These and other objects, advantages and features are attained, in accordance with the principles of this invention, by an electric lamp comprising a sealed, light-transmitting envelope having a bulbous portion and a press sealed end portion, at least one filament located within the interior of the bulbous portion of the envelope, a pair of lead-in conductors each connected to the filament and sealed within the press sealed end portion of the envelope and exteriorly projecting therefrom, and an electrically insulating base member secured to the press sealed end portion of the envelope adjacent the bulbous portion. The base includes therein means for maintaining the exteriorly protruding portions of the lead-in conductors in predetermined alignment within a respective external surface of the insulating base member.

BEST MODE FOR CARRYING OUT THE INVENTION

Figure 1:
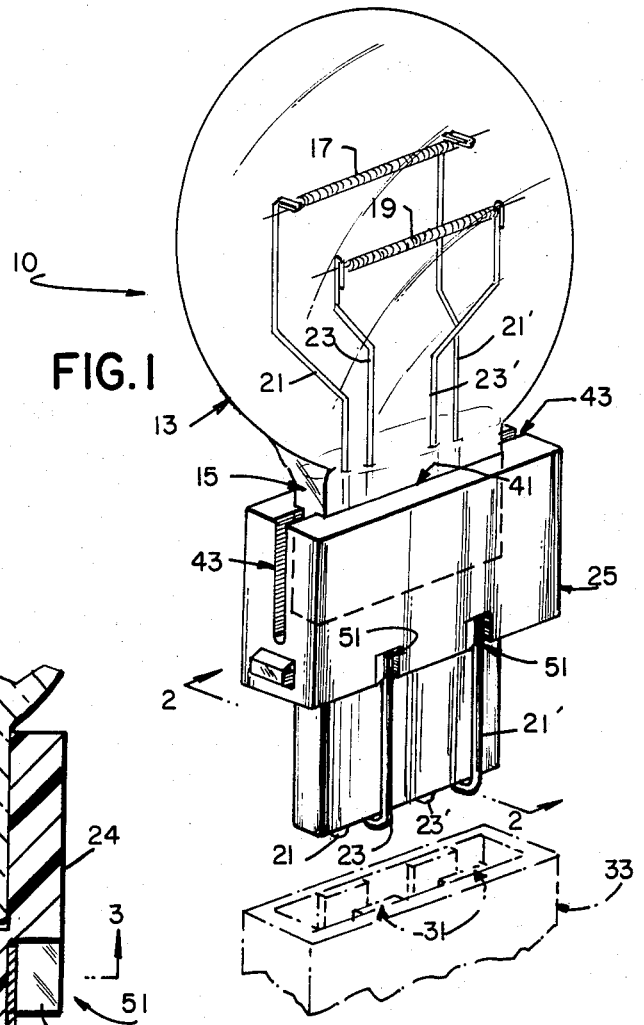
FIG. 1 is a perspective view of an electric incandescent lamp in accordance with the principles of the instant invention.

For a better understanding of the present invention together with other and further objects, advantages and capabilities thereof, reference is made to the following disclosure and appended claims in connection with the above-described drawings.

With particular attention to the drawings, there is illustrated an electric incandescent lamp 10 in accordance with the teachings of the invention. Lamp 10, as stated above, is particularly adapted for use as part of a tail light assembly in an automobile but it will also be understood from the teachings herein that the invention has many further uses (e.g., automobile and aircraft instrument lighting, telephone switchboard lighting, etc.) and these teachings are thus not limited to this particular environment. Lamp 10 includes a light-transmitting envelope in the form of a glass (e.g., lime glass) bulb 13, said bulb containing therein a rare gas such as argon established at approximately atmospheric pressure. Bulb 13 is press (pinch) sealed at one end thereof using a pressing operation known in the incandescent lamp industry. Accordingly, further description is not believed necessary. As a result of this pressing operation, a flattened, sealed end portion 15 is formed as part of bulb 13 adjacent the bulbous part of the envelope. End portion 15 is of substantially rectangular configuration when viewed in cross section therethrough, in comparison to the bulbous shape of bulb 13, which may be either substantially cylindrical (tubular) or sperical (round) in shape. As will be explained in greater detail below, forming end portion 15 in the manner and shape defined constitutes an important aspect of the invention. More specifically, end portion 15 as formed by such a pressing technique possesses greater strength (resistance to breakage) over ends sealed using a tipping operation or the like, or sealed in the manner defined in the aforementioned U.S. Pat. Nos. 3,979,627 and 4,028,577. In addition, the substantially rectangular (in cross section) shape resulting from this technique is particularly suited for placement thereon of an insulative base possessing the unique features also taught hereinbelow.

Located within bulb 13 is a pair of filaments 17 and 19, each of which is electrically connected to (and secured by) a corresponding pair of lead-in conductors which are hermetically sealed within end portion 15 of bulb 13 and project exteriorly thereof. The opposing ends of each pair extend within the interior of bulb 13 and may be bent as indicated to assure the desired positioning for both filaments. With particular attention to the drawings, filament 17 is connected (and energized) by lead-in conductors 21 and 21', while filament 19 is connected by conductors 23 and 23'. A total of four conductors thus project exteriorly from sealed end portion 15.

In accordance with one embodiment of the invention, filaments 17 and 19 were each of coiled configuration and comprised of tungsten. By the term coiled configuration is meant that each filament may constitute a singular coil or, alternatively, may be a coiled-coil member. Retention of each filament by the associated pair of lead-in conductors is attained by crimping the interior ends thereof over the opposed ends of the linear filament, said procedure known in the art of incandescent lamp making. Each lead-in conductor may be comprised of a metallic alloy material (e.g., dumet) or similar conductive material known in the art. In one embodiment, each conductor possessed an outer (external) diameter (O D.) of about 0.020 inch and a total length of about 2.700 inch, of which about 1.400 inch projects externally from end portion 15. It is thus understood that a substantial (more than half) portion of each conductor projects exteriorly of sealed end 15.

In accordance with the teachings herein, lamp 10 further includes an electrically insulating (e.g., plastic) base member 25 which, as shown, is secured to the press sealed end portion 15 of the lamp's envelope adjacent the bulbous portion 13 and designed for providing a cover therefor. Base member 25 is of unitary construction and includes a relatively larger first portion 24 and a smaller (in thickness) protruding second portion 24' adjacent first portion 24. Located within second portion 24' are a plurality of apertures 26 (one shown in FIG. 2) each of which extend through the protruding portion 24' and are designed for having a respective exteriorly projecting portion of a lead-in conductor pass therethrough. Although individual apertures 26 are provided for each conductor, it is also possible to utilize a single slot (or channel) for this purpose, wherein all conductors are located therein in a side-by-side, non-contacting (to assure electrical insulation) relationship. First portion 24 of base member 25 also includes therein means for maintaining exteriorly protruding portions of the four lead-in conductors in predetermined alignment within an external surface of a respective one of the sidewalls of the first portion of the insulating base member to thereby asure that these exposed portions will be precisely aligned with corresponding electrical contacts (i.e., 31, shown in phantom in FIG. 1) as might be utilized in a socket 33 (also shown in phantom in FIG. 1) into which the invention is designed for being positioned. As understood herein, this positioning is accomplished by inserting the protruding second portion 24' of the base member 25 directly within a socket such as illustrated in FIG. 1 such that connection is made to the retained and aligned exposed portions of the respective lead-in conductors 21, 21', 23 and 23' in the region of this protruding portion (and thereby against this portion). It is thus possible to provide a socket member of relatively simple construction capable of receiving the instant invention.

Figure 2:
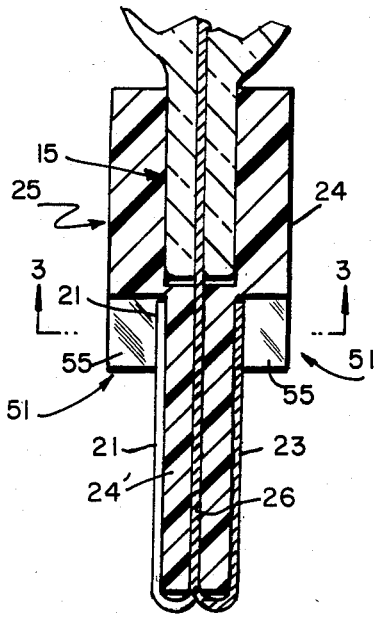
FIG. 2 is an enlarged, side elevational view of the lamp of FIG. 1 as taken along the line 2—2 in FIG. 1.

Base member 25, as stated, is of unitary construction and defines therein an elongated opening 41 also of substantially rectangular configuration and designed for having the flattened press sealed end portion 15 securedly positioned therein. Opening 41 extends into the first portion 24 of base member 25 an established depth, as indicated in FIG. 2. To assure positive positioning therein without causing damage to the sealed end portion 15, the first portion 24 of base member 25 further includes flexure means 43 therein to enable this part of the base member to expand a predetermined amount during said positioning. Flexure means 43 is preferably in the form of two elongated slots formed within the narrower interconnecting sidewalls of the base member's first portion to thus enable the larger sidewalls to expand outwardly during positioning of the press sealed end portion 15. Preferably, two slots are utilized, although it is understood that only one of these may be provided.

To maintain the externally projecting portions of the four lead-in conductors (those portions which project from the protruding second portion 24' of base member 25) in the described predetermined alignment and thereby assure effective contact therewith at the location indicated, base member 25 further includes a plurality of spacedly positioned channels 51, each located within the lowermost portion of the first portion of the base member and designed for having one of the terminal ends of a respective conductor inserted therein. As will be described below, each of these channels is designed for securedly retaining these terminal ends in a locking relationship to thus prevent subsequent removal thereof during the aforementioned positioning of the invention within a corresponding socket member. A total of four channels are provided, one for each of the mentioned lead-in conductors. It is understood in the broader aspects of its invention, however, that only two such channel members may be provided in the event that only one filament is utilized (and thus only two lead-in conductors similarly employed). Because it is desired to position the conductors from each filament on opposite sides of the base member's first portion 24, it is understood that if only two channel members are employed, these would also be oriented within said opposite sides (or sidewalls) of the first portion.

Figure 3:
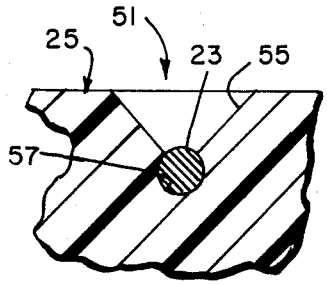
FIG. 3 is an enlarged, end elevational view, in section, of the lamp of FIG. 1 as taken along the line 3—3 in FIG. 2.

As better depicted in FIGS. 2 and 3, each channel includes a tapered portion 55 which, as illustrated, facilitates positioning of the substantially annular (round) conductors therein. Accordingly, each channel further includes an annular opening 57 at the bottom thereof. With particular attention to FIG. 3, each of the illustrated tapered portions 55 defines a relatively narrow passage between these tapered walls and the corresponding annular opening 57. Said passage is of a narrower width than the corresponding external diameter for the respective lead-in conductor being positioned therein. In addition, the corresponding annular opening 57 designed to accommodate the conductor is of an outer diameter substantially similar (or perhaps very slightly larger) than the corresponding outer diameter of the conductor. Understandably, the metallic conductor, when pressed within annular opening 57, is thus retained therein (and thus against the narrower protruding portion 24') in the aforementioned locking relationship.

There has thus been shown and described an electric incandescent lamp wherein the externally projecting lead-in conductors thereof are positively retained in a predetermined alignment to enable positive connection thereto by the respective contacts or the like located within a socket member in which the lamp is positioned. The combination as defined herein provides a lamp wherein the protruding, second portion of the base member, having the conductors retained therein, may be directly inserted within a suitable socket member to thus assure positive electrical connection of the type defined without causing damage to the invention.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electric lamp comprising:

a sealed, light-transmitting glass envelope having a bulbous portion and a press sealed end portion, said press sealed end portion substantially rectangular is cross section;

at least one filament located within the interior of said bulbous portion of said envelope;

a pair of lead-in conductors each connected at one end thereof to said filament, each of said conductors sealed within said press sealed end portion of said envelope and projecting exteriorly thereof; and an electrically insulating base member including a first portion having an opening therein and a protruding second portion adjacent said first portion for being positioned within a socket having electrical contacts therein, said press sealed end portion of said envelope being securedly positioned within said opening, said first portion of said base member thereby providing a cover for said press sealed end portion, each of said exteriorly projecting portions of said conductors passing through said protruding second portion and protruding externally thereof, said first portion of said insulating base member including means for maintaining the externally protruding portions of said conductors in predetermined alignment within said first portion and against a respective external surface of said protruding second portion such that electrical contact can be provided between said electrical contacts within said socket and said external protruding portions of said conductors in the region of said protruding second portion when said second portion is positioned within said socket, said first portion of said base member including flexure means therein for enabling the sidewalls of said first portion to expand outwardly during positioning of said press sealed end portion of said glass envelope therein to prevent damage to said sealed end portion and to enable said press sealed end portion to be positioned within said first portion without the need for adhesives or the like.

2. The electric lamp according to claim 1 wherein said flexure means comprises at least one elongated slot located within a sidewall of said first portion of said base member.

3. The electric lamp according to claim 2 wherein the number of said elongated slots is two, each located within a respective one of two spaced-apart sidewalls of said first portion of said base member.

4. The electric lamp according to claim 1 wherein said means for maintaining said exteriorly protruding portions of each of said lead-in conductors in said predetermined alignment against said respective external surface of said protruding portion of said base member comprises a pair of channels, each of said channels located within a respective sidewall of said first portion of said base member and retaining an end segment of a respective one of said lead-in conductors therein in a locking relationship.

5. The electric lamp according to claim 4 wherein each of said channels includes a tapered portion to facilitate positioning of said lead-in conductor therein and a substantially annular opening adjacent said tapered portion for having said conductor located therein.

6. The electric lamp according to claim 5 wherein each of said conductors is of annular configuration in cross section, each of said annular openings having said conductor located therein having a diameter substantially the same as said conductor.

7. The electric lamp according to claim 6 wherein each of said tapered portions defines a passage to said annular opening substantially smaller than the external diameter of each of said lead-in conductors to thereby assist in retaining said conductor within said annular opening in said locking relationship.

8. The electric lamp according to claim 1 wherein said base member is plastic.

* * * * *